US006459010B1

(12) United States Patent
Carpena et al.

(10) Patent No.: US 6,459,010 B1
(45) Date of Patent: Oct. 1, 2002

(54) METHOD FOR PACKAGING INDUSTRIAL, IN PARTICULAR RADIOACTIVE, WASTE IN APATITE CERAMICS

(75) Inventors: Joëlle Carpena, Jouques; Benoît Donazzon, Lanta; Jean-Louis Lacout, Irwlonge; Gérard Dechambre, Saint Orens, all of (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 09/581,227

(22) PCT Filed: Dec. 22, 1998

(86) PCT No.: PCT/FR98/02826

§ 371 (c)(1),
(2), (4) Date: Jun. 23, 2000

(87) PCT Pub. No.: WO99/34370

PCT Pub. Date: Jul. 8, 1999

(30) Foreign Application Priority Data

Dec. 23, 1997 (FR) ..... 97 16356

(51) Int. Cl.[7] ..... G21F 9/16
(52) U.S. Cl. ..... 588/10; 588/252
(58) Field of Search ..... 588/1, 2, 9, 10, 588/11, 14, 15, 252

(56) References Cited

U.S. PATENT DOCUMENTS 5,646,972 A * 7/1997 Carpena et al. ..... 376/272
5,678,233 A * 10/1997 Brown ..... 588/2
5,711,016 A * 1/1998 Carpena et al. ..... 588/10
5,771,472 A * 6/1998 Carpena et al. ..... 588/2

FOREIGN PATENT DOCUMENTS

| | | | | |
|---|---|---|---|---|
| FR | 2 712 726 | | 5/1995 | |
| FR | 2 728 812 A | * | 7/1996 | |
| WO | WO 95-02886 | * | 1/1995 | ..... G21F/9/34 |
| WO | WO 96 18196 A | * | 6/1996 | |

OTHER PUBLICATIONS

N.F. Feborov, et al., Inorganic Materials, vol. 9, No. 4, pps. 652–654, "Synthesis and Investigation of Silicate–Fluorapatites with the Composition $M_4Ln_6[SiO_4]_6F_2$, Where M IS Ca OR Sr, Ln IS Nd, Y or Yb," 1973.

R. Bros, et al., Radiochimica Acta, vol. 74, pps. 277–282, "Occurrence of Pu and Fissiogenic REE in Hydrotheremal Apatites from the Fossil Nuclear Reactor 16 Oklo (Gabon), "1996.

* cited by examiner

*Primary Examiner*—Wayne A. Langel
*Assistant Examiner*—Eileen E. Nave
(74) *Attorney, Agent, or Firm*—Oblon, Spivak, McClelland, Maier & Neustadt, P.C.

(57) ABSTRACT

The invention involves a process for containment of industrial wastes, particularly nuclear wastes, in apatite ceramics. This process involves preparing a homogeneous mixture of powders which can form an apatite matrix, introducing the waste into this mixture, compacting it under a pressure of 100 to 500 MPa at room temperature, and subjecting it to hydrothermal processing at low temperature (100 to 500° C.) in the presence of water in a sealed chamber.

13 Claims, No Drawings

METHOD FOR PACKAGING INDUSTRIAL, IN PARTICULAR RADIOACTIVE, WASTE IN APATITE CERAMICS

FIELD OF THE INVENTION

This invention involves a process for containment of industrial wastes, particularly nuclear wastes, in apatite ceramics.

Apatite ceramics are valuable materials for use as matrices for the containment of industrial wastes, and particularly nuclear wastes and especially those with long half-lives such as fission products or certain actinides.

In irradiated nuclear fuel treatment plants at the end of the processing there are several actinide elements with long half-lives and some lanthanides which must be contained for long-term storage in highly resistant matrices.

The materials used for the matrices must have very high chemical stability, stability to radiation, and stability to temperature, to isolate the radioactive elements from the environment and keep them in this isolated state for very long periods, due to their long period of radioactivity.

STATE OF THE PRIOR ART

The matrix currently used for containment is glass, but recent studies have indicated that apatite ceramics have properties which are particularly suitable for long-term storage and could be used instead of glass as confinement matrices.

The apatites are compounds with the general formula:

$$Me_{10}(XO_4)_6Y_2 \quad (I)$$

in which Me is one or several metals, X represents P, V and/or Si, and Y represents one or several anions such as OH, Cl and F. Among these apatites, phosphocalcic hydroxy apatite:

$$Ca_{10}(PO_4)_6(OH)_2 \quad (II)$$

is the best known compound.

The apatites of formula (I) can have various substitutions, for the cationic sites (Me) as well as for the anionic sites ($XO_4$ and/or $Y_2$).

The charge equilibrium, needed because of the introduction of elements which may be monovalent, divalent, trivalent or tetravalent, is established by various associated substitutions.

For example, divalent calcium can be replaced by a rare earth which is a trivalent element. This replacement can occur in several ways:

by the coupled exchange $(Ca^{2+}, OH^-) \leftrightarrows (Ln^{3+}, O^{2-})$ by the coupled exchange $(Ca^{2+}, PO_4^{3-}) \leftrightarrows (Ln^{3+}, SiO_4^{4-})$ by the coupled exchange $(2Ca^{2+}) \leftrightarrows (Ln^{3+}, Na^+)$ This is just an example of the multiple substitutions which are possible.

As described by BROS R., CARPENA J., SERE V., BELTRITTI A, Radiochimica Acta, 74, 1996, pages 277–282 [1], the study of the OKLO natural reactor showed that apatites containing radioelements in their structures (actinides and/or fission products) are particularly stable, thermally and chemically, even in highly irradiating media.

These apatites are resistant in radioactive waste storage conditions to more than 1,000° C. They are chemically resistant in hydrogeological storage conditions, i.e. with a water pH which is neutral or basic. They can also withstand highly irradiating media because the radiation damage which they suffer is unstable at temperatures greater than 60° C. Phosphocalcic apatite, for example, can restructure itself as of 60° C.

The advantage of apatites for geological storage of industrial wastes, and particularly nuclear wastes with low, moderate or high activity, is evident, because they allow for strong chemical bonding in a matrix which is particularly stable with a continuity in geological media which has been demonstrated by studies of materials several million years old.

Massive polycrystalline shapes of these apatites are needed for containment of industrial wastes, and particularly radioactive wastes.

Until now, the preparation of massive apatite pieces containing wastes was done from powdery apatites subjected to sintering at high temperatures, i.e. greater than 1,000° C., possibly under high pressure.

The document FR-A-2 712 726 [2] describes a process for containment of actinides and/or lanthanides in apatite, involving the preparation of a mixture of powders including at least one phosphate chosen from among calcium, lanthanide and actinide phosphate, calcium fluoride, calcium carbonate, a silicon compound and possibly one or several lanthanide or actinide oxides, thermally treating the mixture to break down the calcium carbonate and calcinating the thermally-treated mixture at a high temperature (900 to 1,500° C.), possibly repeating the last calcination step several times after one or several intermediate grinding steps.

The document Inorganic Materials, volume 9, no. 4, 1973, pages 652–654 [3] also describes a process for manufacturing fluoroapatite silicates containing lanthanides by thermal treatment at a high temperature (1,200 to 1,350° C.).

Other processes for manufacturing of an apatite ceramic-based waste containment matrix involve the prior preparation of apatite power, its grading and sintering according to various processes such as natural sintering, pressure-assisted sintering, and sintering after using slip.

These techniques yield mass pieces with good mechanical properties, but they require high-temperature thermal treatments involving:

- high costs of energy for preparation of the matrix
- partial transformation of hydroxyapatite to oxyapatite, and
- difficulties in enclosing species which are volatile at the temperature of the thermal treatment in the piece of apatite.

BRIEF DESCRIPTION OF THE INVENTION

This invention precisely involves a process for containment of industrial wastes in apatite ceramics which produces pieces with good mechanical properties but without the need for thermal treatment at high temperatures.

According to the invention, the process for containment of industrial waste in a apatite ceramic matrix involves the following steps:

a) preparing a homogeneous mixture of powders, comprising:
   i) at least two calcium phosphates selected from the group consisting of $Ca(H_2PO_4)_2$, $Ca(H_2PO_4)_2.H_2O$, $Ca(HPO_4)$, $Ca(HPO_4).2H_2O$, amorphous $\alpha$-$Ca_3(PO_4)_2$, apatitic $\alpha$-$Ca_3(PO_4)_2$, amorphous $\beta$-$Ca_3(PO_4)_2$, apatitic $\beta$-$Ca_3(PO_4)_2$, $Ca_4(PO_4)_2O$; and optionally
   ii) at least one compound selected from the group consisting of alkaline metal salts, alkaline metal phosphates, alkaline metal silicates, alkaline metal carbonates, alkaline metal halides, alkaline metal oxides, alkaline metal hydroxides, alkaline-earth metal salts, alkaline-earth metal phosphates, alkaline-earth metal silicates, alkaline-earth metal carbonates, alkaline-earth metal halides, alkaline-earth metal oxides, alkaline-earth metal hydroxides, and oxides of silicon, wherein the mixture is able to form a stoichiometric hydroxyapatite of formula (II)

$$Ca_{10}(PO_4)_6(OH)_2 \quad (II)$$

wherein calcium is partly replaced by at least one member selected from the group consisting of alkaline metals and alkaline-earth metals;

phosphate anions are partly replaced by silicate anions; and hydroxide anions are party replaced by halide anions;

b) putting the industrial wastes into the mixture;

c) compacting the mixture of powders containing the aforesaid waste at room temperature, under a pressure of 100 to 500 MPa, to yield a compacted piece; and d) subjecting the compacted piece to hydrothermal treatment in a sealed chamber containing an aqueous medium, at a temperature of 100 to 500° C., for a period of at least 8 hours.

According to a first embodiment of the invention, particularly intended for containment of industrial wastes including at least one element chosen from the metals and halogens, steps a) and b) are done simultaneously by mixing the waste, during preparation of the mixture of powders, in the form of powders of oxides, hydroxides or salts of the metal(s) and/or alkaline or alkaline earth metal halide powder(s) so as to obtain a mixture corresponding to a hydroxyapatite as defined above, substituted by the metal(s) and/or halogens to be contained.

The metals could in particular be radioactive metals such as radioactive cesium, for example Cesium-135 and Cesium-137, Strontium-90, Technetium-99, the lanthanides, particularly Samarium-151, and the actinides. The halogens could be Chlorine-36 in particular.

According to a second embodiment of the invention more particularly intended for containment of wastes in the form of powders, granulates, massive pieces of variable size or organic wastes, these are put as is into the mixture of powders prepared in step a) so that they are surrounded by the mixture of powders.

Waste of this type can be made for example of powders, granulates, or small massive pieces of apatite or ceramics containing radioactive elements, pre-treated wastes, contaminated technological wastes such as pieces of metal, metallic drums, glass, etc. and of organic materials such as asphalt which contain radioactive elements or other elements.

This second embodiment of the invention can be combined with the first when simultaneously enclosing waste which can enter the chemical structure of the apatite and the other wastes.

The invention process thus allows for preparation of the apatite ceramic matrix at low temperatures, using a hydrothermal reaction between various phosphatised compounds and possibly other compounds present in the mixture, which were first compacted.

In step a) of this process, a mixture of powders which can yield a hydroxyapatite with the following formula is prepared:

$$Ca_{10}(PO_4)_6(OH)_2$$

in which the anions and/or cations can be substituted by other cations and anions, and in particular by the element(s) of the waste to be contained.

This hydroxyapatite can in particular be a silicated apatite such as those described in FR-A-2 712 726 [2], which may or may not contain lanthanides and/or actinides in its structure.

The mixture can be prepared by grinding the ingredients to a size grading of less than 100 $\mu$m. Some components, such as calcium phosphates, can be in the form of a single powder obtained by co-grinding.

According to the invention, the mixture includes at least two phosphate compounds, in particular a basic compound (tetracalcium phosphate) and one or several acidic compounds (dicalcium or monocalcium phosphate). Phosphatised compounds, oxides, hydroxides and salts of alkaline metal or alkaline-earth metals or metals forming the waste to be contained can also be added to provoke various substitutions in the hydroxyapatite.

The salts used can be in particular phosphates, silicates, nitrates, halides or carbonates.

The mixture is then subjected to compacting step c) after introduction of the waste for containment, if it is not part of the mixture.

The compacting is done at room temperature, for example at a temperature of 15 to 30° C., under a pressure of 100 to 500 MPa, preferably 200 MPa, for example by means of a hydraulic press, after putting the mixture into a mould.

In the next step d), the compacted piece is subjected to a hydrothermal treatment in a sealed chamber in the presence of an aqueous medium brought to a temperature of 100 to 500° C., under a pressure which corresponds to the pressure of water vapour at the chosen temperature.

This treatment yields a ceramic form by hydrothermal reaction between the ingredients in the compacted mixture. Pieces with exceptional hardness can thus be obtained because acicular crystals of apatite which condition the cohesion of this material have developed within the massive material.

The hydrothermal treatment can be done in two ways.

According to a first embodiment of the treatment, the compacted piece is totally immersed in the aqueous medium so that it is in contact with the water in the liquid state.

According to a second embodiment of this hydrothermal treatment, preferably used for compacted pieces including compounds which are soluble in aqueous media, the compacted piece is arranged above the liquid medium so that it is only in contact with the water vapour produced within the sealed chamber under the effect of the treatment temperature.

The hydrothermal treatment temperature is between 100 and 500° C., and the duration of this hydrothermal treatment depends in particular on the temperature used, the duration being longer when the temperature is lower. The duration is generally at least 8 hours and can be from 12 to 60 hours.

The hydrothermal treatment temperature is preferably 150 to 250° C. for a period of about 48 hours.

The aqueous medium used is usually demineralised water, but an aqueous solution containing appropriate additives could also be used.

According to a variant of the invention process embodiment, there is an additional step e) of sintering of the compacted piece which was subjected to hydrothermal treatment. This sintering is done at a temperature of at least 1,000° C., for example between 1,000 and 1,300° C.

Highly compacted materials with excellent mechanical properties can thus be obtained for safe containment of wastes for long-term storage.

The invention process is particularly advantageous because it can yield various compositions of apatite ceramic matrices by choosing the compounds used in step a).

When an apatite ceramic matrix of the phosphocalcic hydroxyapatite type is to be prepared, a mixture of various calcium phosphate compounds is used such as $Ca(H_2PO_4)_2$, $Ca(H_2PO_4)_2.H_2O$, amorphous $\alpha Ca_3(PO_4)_2$, apatitic $\alpha$-$Ca_3(PO_4)_2$, amorphous $\beta$-$Ca_3(PO_4)_2$, apatitic $\beta$-$Ca_3(PO_4)_2$, and $Ca_4(PO_4)_2O$; The calcium phosphate compounds may be in proportions such that the fin composition is that of a hydroxyapatite of the formula:

$$Ca_{10}(PO_4)_6(OH)_2 \quad \text{(II)}$$

wherein calcium is partly replaced by at least one member selected from the group consisting of alkaline metals and alkaline-earth metals;

phosphate anions are partly replaced by silicate anions; and hydroxide anions are partly replaced by halide anions.

Starting with a mixture of powders including compounds other than these calcium phosphates, apatites can be made with substitution:

of the cation Me, with strontium for example, of the $PO_4$ group, with silicate groups for example, on the OH anion, with fluoride or chloride ions for example.

Some of the compounds used can have elements from wastes such as radioactive elements such that, at the end of the operation, an apatite ceramic matrix is obtained which encloses radioactive elements in its structure, thus allowing for their containment for long-term storage.

The invention process can also use the two techniques for incorporation of wastes by including part of them in the chemical structure of the apatite matrix and another part of them in the mixture of powders which undergoes compaction.

Other characteristics and advantages of the invention will be clearer with a reading of the following examples which are purely illustrative and in no way limiting.

DETAILED DESCRIPTION OF EMBODIMENTS OF THE INVENTION

EXAMPLE 1

Containment of Radioactive Waste in a Matrix of Phosphocalcic Hydroxyapatite In this example, the phosphocalcic hydroxyapatite matrix is directly prepared around a block containing radioactive wastes.

First, a mixture of powders is made from the three calcium phosphates which are:

hydrated monocalcium phosphate, $Ca(H_2PO_4)_2.H_2O$ tricalcium phosphate $Ca_3(PO_4)_2$, and tetracalcium phosphate $Ca_4(PO_4)_2O$.

The proportion of each ingredient is calculated from the following reaction:

$$a\ Ca(H_2PO_4)_2.H_2O + b\ Ca_3(PO_4)_2 + c\ Ca_4(PO_4)_2O \rightarrow Ca_{10}(PO_4)_6(OH)_2 \text{(in the presence of water)}$$

where the coefficients a, b and c are related by the following equation:

$$b=2-3a,\ c=1+2a$$

with $0 \cdot a \cdot 0.67$; $0 \cdot b \cdot 2$ and $1 \cdot c \cdot 2.33$.

In this example, the following values are used:

a=0.225 b=1.325, and c=1.45

After formation of a homogenous mixture by grinding to a size grading of less than 100 $\mu$m, the mixture of powders is put in a mould so that it surrounds the block of radioactive wastes, then it is subjected to compacting in the mould under a pressure of 200 MPa by means of a hydraulic press.

After removal of the compacted piece from the mould, it is put into an autoclave containing demineralised water so that it is totally immersed in the demineralised water. After the closing of the autoclave, it is put into an oven which is brought to 200° C. for a period of 48 hours.

This yields a piece with a apatite ceramic matrix arranged around a block of radioactive waste. The resistance to compression of the piece is 90 to 100 MPa.

EXAMPLE 2

Containment of Neodymium in an Apatite Ceramic Matrix

In this example, a mixture of powders is made from the three calcium phosphates used in example 1 with addition of amorphous silica and the waste which is neodymium nitrate $Nd(NO_3)_3$. The proportion of each component is calculated by the following reaction:

$$a\ Ca(H_2PO_4)_2,\ H_2O + b\ Ca_3(PO_4)_2 + c\ Ca_4(PO_4)_2O + X\ SiO_2 + x\ Nd(NO_3)_3 \rightarrow Ca_{(10-x)}Nd_x(PO_4)_{6-x}(SiO_4)_x(OH)_2 \text{ (in the presence of water)}$$

For x=1, this yield the apatite ceramic of formula $Ca_9Nd(PO_4)_5(SiO_4)(OH)_2$.

In this reaction, the coefficients a, b, c and x are related by the following equations:

$$b=2-x-3a$$

$$c=1+0.5x+2a$$

It appears that the maximum quantity of neodymium is equal to 2 atoms per cell or x=2.

In this example the following values are chosen:

x=1 a=0.333 b=0 and c=2.167.

After homogeneous mixing of the powders by grinding, the powders are put into a mould in which they are subjected to compacting under a pressure of 420 MPa.

After removal of the compacted piece from the mould, it is put into an autoclave containing demineralised water so that it is totally immersed in the demineralised water. After the closing of the autoclave the temperature is brought to 200° C. for a period of 48 hours.

This yields a dense piece of silicated apatite containing neodymium.

EXAMPLE 3

Containment of Radioactive Cesium in an Apatite Ceramic

Cesium is very hard to bind because it is volatile and very mobile. The half-life is $2.3 \times 10^6$ years for Cs-135 and 30 years for Cs-137.

To enclose this long half-life product in an apatite ceramic, it is first associated with zirconium phosphate.

A solution of Cesium-135 is percolated on a zirconium phosphate of formula $Zr(HPO_4)_2.\ nH_2O$ which binds the cesium present in the solution by exchange with its proton. After filtering and drying, this yields zirconium phosphate loaded with cesium in the form of a powder.

This powder is enclosed in an apatite ceramic in the following manner. The zirconium phosphate powder containing cesium is mixed with the three calcium phosphates used in example 1, in the same proportions as in example 1, and then the powder mixture is subjected to compacting under 200 MPa.

After removal of the compacted piece, it is put in an autoclave containing demineralised water and is brought to a temperature of 200° C., which corresponds to a pressure of 1.6 MPa, for a period of 48 hours.

This yields an apatite ceramic containing zirconium phosphate loaded with cesium.

Salting out tests for cesium in water were done for several weeks and showed that there was no release of cesium into the water.

EXAMPLE 4

Containment of Radioactive Cesium in an Apatite Ceramic

In this example the same operating mode as in example 3 is followed to enclose zirconium phosphate loaded with cesium in an apatite ceramic, but before putting the zirconium phosphate loaded with cesium into the powder mixture, it is pressed into tablet form with pressure of 200 MPa. The mixture of the three calcium phosphate powders is placed around the tablet and then the compacting and hydrothermal treatment is done as in example 3.

This yields a block containing cesium with properties equivalent to those of the block in example 3.

EXAMPLE 5

Containment of Neodymium in an Apatite Ceramic

In this example, the same operating mode as in example 2 is used to introduce the neodymium into a silicated apatite ceramic, but the piece obtained after the hydrothermal treatment is then subjected to another high temperature treatment to produce a britholite. This treatment involves heating the block to 1,100° C.

The advantage of this treatment with respect to the treatment used in FR-A-2 712 726 [2] is that it gives a britholite structure in a single step at 1,100° C., while in FR-A-2 712 726 several calcinations mixed with numerous intermediate grindings were needed to obtain a piece with this structure.

The invention process thus yields an analogous apatite at a lower temperature and more rapidly.

EXAMPLE 6

Apatite Containment of Radioactive Strontium in an Apatite Ceramic

In this example, the same operating mode as in example 2 is used to introduce strontium into the apatite network starting from a mixture of powders of hydrated monocalcium phosphate, tetracalcium phosphate and strontium and calcium phosphate $Ca_2Sr(HPO_4)_2$. The proportion of each component is calculated from the following reaction:

$$a\ Ca(HPO_4)_2.H_2O + b\ Ca_4Sr(PO_4)_2 + c\ Ca_4(PO_4)_2O \rightarrow Ca_9Sr(PO_4)_6(OH)_2$$

with:

a=0.34 b=1 c=1.66

These ingredients are mixed by grinding, then the mixture of the powders is put into a mould and it is compressed by means of a hydraulic press under pressure of 190 MPa. The compressed piece obtained is then put into an autoclave and covered with demineralised water. The autoclave is closed and the temperature is brought to 200° C., which corresponds to a water vapour pressure of 1.6 MPa, for a period of 72 hours.

This yields a calcium-strontium hydroxyapatite which allows for long-term storage of strontium.

The invention process is very advantageous for the containment of nuclear wastes because it produces blocks with good mechanical properties and in particular strong resistance to compression (more than 100 MPa), good thermal stability to temperatures of more than 1000° C., good chemical stability in the presence of water and good resistance to nuclear radiation. The blocks obtained by this process can be easily machined.

REFERENCES CITED

[1]: BROS R., CARPENA J., SERE V., BELTRITTI A., Radiochimica Acta, 74, 1996, pages 277–282

[2]: FR-A-2 712 726.

[3]: Inorganic Materials, Vol. 9, no. 4, 1973, pages 652–654.

What is claimed is:

1. A process for containment of industrial waste in an apatite ceramic matrix comprising the following steps:

a) preparing a homogeneous mixture of powders, comprising:

i) at least two calcium phosphates selected from the group consisting of $Ca(H_2PO_4)_2$, $Ca(H_2PO_4)_2.H_2O$, $Ca(HPO_4)$, $Ca(HPO_4).2H_2O$, amorphous $\alpha$-$Ca_3(PO_4)_2$, apatitic $\alpha$-$Ca_3(PO_4)_2$, amorphous $\beta$-$Ca_3(PO_4)_2$, apatitic $\beta$-$Ca_3(PO_4)_2$, and $Ca_4(PO_4)_2O$; and optionally ii) at least one compound selected from the group consisting of alkaline metal salts, alkaline metal phosphates, alkaline metal silicates, alkaline metal carbonates, alkaline metal halides, alkaline metal oxides, alkaline metal hydroxides, alkaline-earth metal salts, alkaline-earth metal phosphates, alkaline-earth metal silicates, alkaline-earth metal carbonates, alkaline-earth metal halides, alkaline-earth metal oxides, alkaline-earth metal hydroxides, and oxides of silicon, wherein the mixture forms a stoichiometric hydroxyapatite of formula (II)

$$Ca_{10}(PO_4)_6(OH)_2 \quad \text{(II)}$$

wherein calcium is partly replaced by at least one member selected from the group consisting of alkaline metals and alkaline-earth metals;

phosphate anions are partly replaced by silicate anions; and hydroxide anions are partly replaced by halide anions;

b) putting the industrial waste into the mixture;

c) compacting the mixture of powders containing the industrial waste at room temperature, under a pressure of 100 to 500 MPa, to yield a compacted piece; and d) subjecting the compacted piece to hydrothermal treatment in a sealed chamber containing an aqueous medium, at a temperature of 100 to 500° C., for a period of at least 8 hours.

2. The process according to claim 1, wherein the industrial waste including at least one element selected from the group consisting of metals and halogens, and steps a) and b) are done simultaneously by putting the industrial waste, during the preparation of the powder mixture in the form of powders of oxides, hydroxides, or salts of the metal(s), and/or powders(s) of halide(s) of the alkaline or alkaline-earth metal so as to yield a mixture corresponding to a hydroxyapatite of formula (II), substituted by the at least one element to be contained.

3. The process according to claim 2, wherein the element is selected from the group consisting of radioactive Cesium, Strontium-90, Technetium-99, lanthanides, actinides and Chlorine-36.

4. The process according to claim 1, wherein the industrial waste is put into the homogeneous mixture of powders prepared in step a) so that it is surrounded by this homogeneous mixture of powders.

5. The process according to claim 1, wherein the industrial waste is a ceramic made from zirconium phosphate loaded with radioactive cesium.

6. The process according to claim 1, further comprising an additional step of:

e) sintering the compacted piece subjected to hydrothermal treatment obtained in step d) at a temperature of at least 1,000° C.

7. The process according to claim 1, wherein the homogenous mixture of powders in step a) are obtained by grinding.

8. The process according to claim 1, wherein the compacted piece in step d) is totally immersed in the aqueous medium.

9. The process according to claim 1, wherein the compacted piece in step d) is arranged above the aqueous medium.

10. The process according to claim 1, wherein the sealed chamber used in step d) has a water vapor pressure from 0.5 to 17 MPa.

11. The process according to claim 1, wherein the period of hydrothermal treatment is from 12 to 60 hours.

12. The process according to claim 1, wherein the aqueous medium is demineralized water.

13. The process according to claim 1, wherein the industrial waste is radioactive waste.

* * * * *